United States Patent [19]

Ikebuchi et al.

[11] Patent Number: 4,905,915

[45] Date of Patent: Mar. 6, 1990

[54] METHOD AND APPARATUS FOR PULVERIZING PARTICULATE MATERIAL

[75] Inventors: Iwao Ikebuchi; Yoshitaka Ihara; Akira Ganse; Tomio Kaneyasu, all of Yao, Japan

[73] Assignee: Kubota, Ltd., Osaka, Japan

[21] Appl. No.: 302,527

[22] Filed: Jan. 27, 1989

[30] Foreign Application Priority Data

Jan. 28, 1988 [JP] Japan ..... 63-17724

[51] Int. Cl.[4] ..... B02C 17/16

[52] U.S. Cl. ..... 241/21; 241/24; 241/80; 241/97

[58] Field of Search ..... 241/80, 97, 46.17, 171, 241/172, 24, 21, 79.1

[56] References Cited

U.S. PATENT DOCUMENTS 3,298,618 1/1967 Talpey ..... 241/172 X 3,332,628 7/1967 Wadham ..... 241/172 X

FOREIGN PATENT DOCUMENTS 3021071 1/1981 Fed. Rep. of Germany ... 241/46.17

*Primary Examiner*—Mark Rosenbaum

*Attorney, Agent, or Firm*—Armstrong, Nikaido, Marmelstein, Kubovcik & Murray

[57] ABSTRACT

A method and apparatus for pulverizing a material such as sand to a desired particle size. The apparatus has a pulverizing shell in which the material to be pulverized is fed and pulverized. The pulverized fluid-carried material overflows the shell so as to be fed into a settling classifier, where the coarser material settles and is discharged through its bottom opening back into the shell for repulverization. The finer material overflows the classifier and is fed to an intermediate bin, which has its bottom connected to the shell through a valve. When the bin is filled up with the material, the valve is opened so that the material in the bin is returned to the shell. The material is thus circulated through the shell, classifier and intermediate bin. The shell is adapted to be alternately connected to the intermediate bin and a product collector bin by a changeover valve. When the material overflowing the shell is pulverized to a desired particle, size, the shell is now brought into communication with the collector bin.

4 Claims, 3 Drawing Sheets

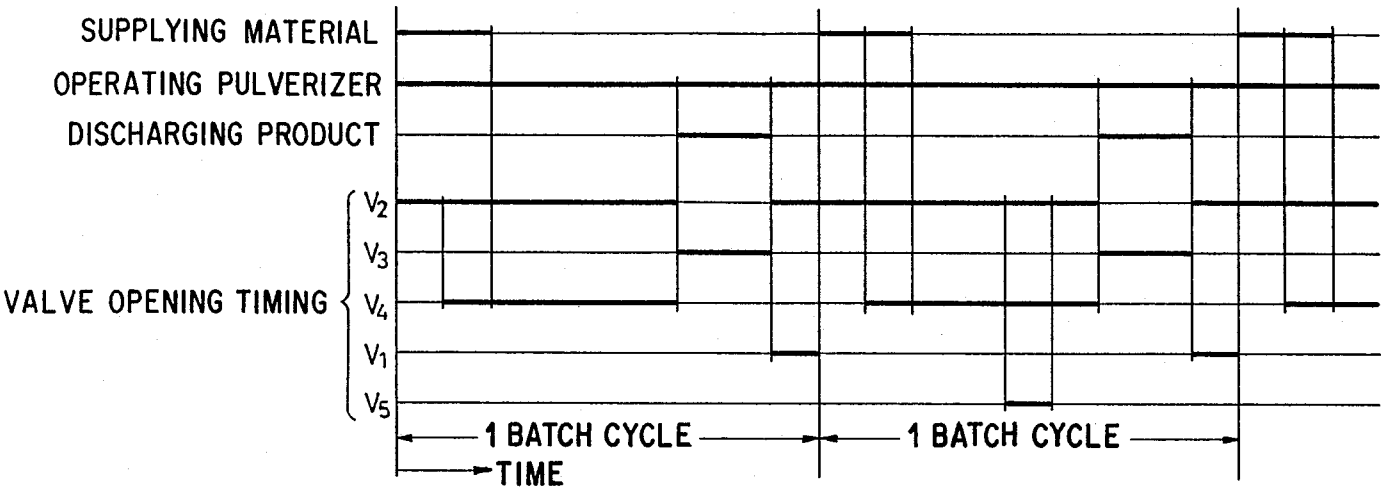
FIG. 6
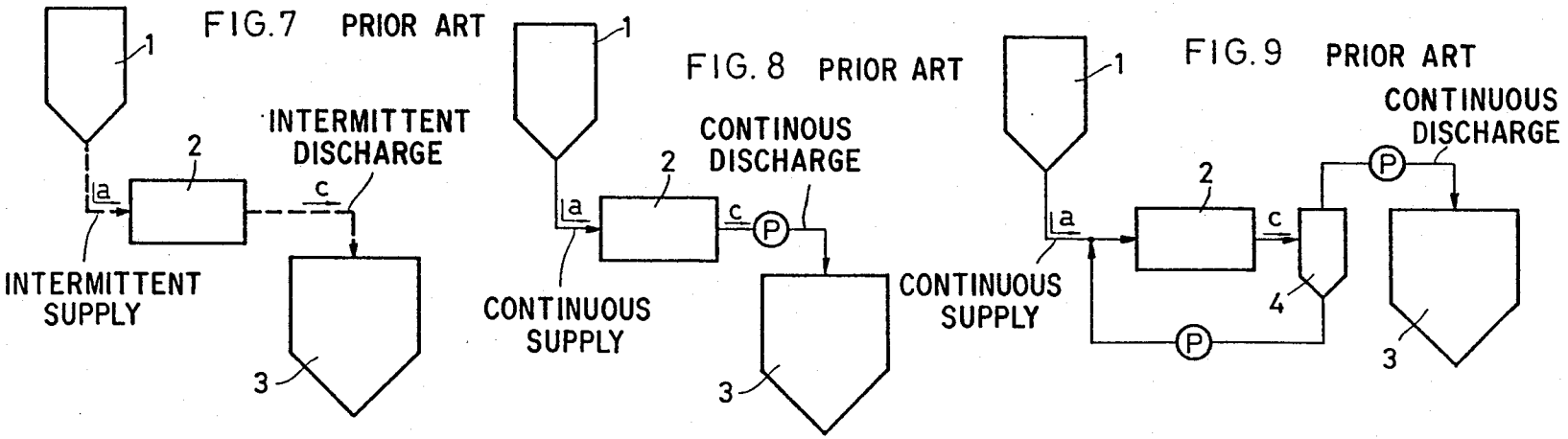
FIG. 7 PRIOR ART
FIG. 8 PRIOR ART
FIG. 9 PRIOR ART

METHOD AND APPARATUS FOR PULVERIZING PARTICULATE MATERIAL

The present invention relates to a method and apparatus for pulverizing sand to a desired particle size.

There are two known methods for pulverizing such a material as sand. FIG. 7 shows one of the two methods in which the material is fed and pulverized in batches. FIGS. 8 and 9 show the other method in which the material is pulverized continuously.

In the former method, as shown in FIG. 7, the material a to be pulverized in a supply bin 1 is fed into a pulverizer 2 by a predetermined amount. The pulverizer 2 is then actuated to grind the material to a desired particle size. It is then stopped and the pulverized product c is discharged into an end product collector bin 3.

In the latter or continuous method, as shown in FIG. 8, the material a to be pulverized in the supply bin 1 is continuously fed into the pulverizer 2 and pulverized into a product c, which overflows the pulverizer and is fed into the collector bin 3. As shown in FIG. 9, a classifier 4 may be provided between the pulverizer 2 and the collector bin 3 to collect the pulverized product c of a larger particle size than the predetermined value and return it to the pulverizer 2.

In the batch method, the particle size of the pulverized product c can be easily controlled by adjusting the operating time for the pulverizer 2, thus reducing the ratio of unacceptable coarser product to fully pulverized product. Also, if the material is pulverized in a liquid, the particle size of the pulverized product c is not influenced by the concentration of the liquid in the pulverizer 2.

But this method is time-consuming and thus inefficient, because the pulverizer 2 has to be stopped each time when feeding the material a and when discharging the product c. Also, it will be troublesome to open and close the inlet and outlet ports of the pulverizer when feeding and discharging the material. Furthermore, in order to pulverize the material to such an extent that all the particles of the pulverized product c will have smaller particle sizes than a predetermined value, not only the coarser product but also the one which has already been pulverized to the desired particle size will be pulverized. This will not only lead to the waste of time and energy but also cause part of the material to be over-pulverized too finely to be acceptable. Also, since the output of the pulverized product c per hour including the downtime of the pulverizer is determined by the volume of the pulverizer, a pulverizer of a large volume is needed to increase the output of the product c. This incurs economical losses.

U.S. Pats. No. 4224354 and 3998938 proposed to circulate the material to be pulverized between the pulverizer and the collector bin With this method, the pulverizing efficiency can be improved without increasing the volume of the pulverizer But this method has one drawback that after each cycle of pulverization, the pulverizer has to be stopped until the pulverized product in the collector bin is emptied In other words, this method is a batch method in a broader sense and thus inefficient.

On the other hand, the continuous method is efficient, because the material to be pulverized as well as the pulverized product can be fed and discharged continuously. The pulverized product is less likely to be over-pulverized because it is discharged continuously. Especially with the apparatus in which fluid is used to classify the material by fluid flow, the product c pulverized to a desired particle size is classified and carried by the fluid flow. Thus, the material is less liable to be over-pulverized and the pulverizing efficiency is high.

But in the product c fed into the collector bin, there is a tendency that a rather large amount of particles of larger sizes than required is mixed This will lower the commercial value of the product. The provision of the classifier 4 shown in FIG. 9 may be a partial solution to this problem. But if it is desired to obtain an ultra-fine powdery product 10–0.1 microns in particle size, it is necessary to use an expensive high-grade classifier. Such a classifier is difficult to handle. Further, the pulverizing efficiency is related to the concentration of the fluid used for classification. The higher the concentration, the higher the thickness and the lower the precision of classification. The finer the particle size of the material to be classified, the more conspicuous this tendency will be. Namely, the classification point is limited by the concentration of the fluid.

It is an object of the present invention to provide a method and apparatus for producing a particulate material which has the advantages of both of the above-mentioned two methods and which obviates the abovesaid shortcomings.

In accordance with the present invention, there is provided a method for pulverizing a material into a particulate product by agitating the material to be pulverized in a fluid flow together with a pulverizing medium to pulverize the material by the friction between the particles of the material and between the material and the pulverizing medium, characterised in that the pulverizer is adapted to be selectively connected with an intermediate bin or a product collector bin, so that the pulverizer is firstly connected with the intermediate bin so as to circulate the fluid-carried material between the intermediate bin and the pulverizer until the material is pulverized to a desired particle size, and the pulverizer is then connected with the product collector bin to direct the product pulverized to the desired particle size to the collector bin.

In accordance with the present invention, there is also provided an apparatus for pulverizing a material into a particulate product, comprising a pulverizer having a pulverizing shell in which the material to be pulverized is agitated in a fluid flow together with a pulverizing medium to pulverize the material by the friction between its particles and between the material and the pulverizing medium, an intermediate bin and a product collector bin adapted to be selectively connected with the pulverizer, a valve means for selecting the connection so that the pulverized product in the shell will be carried by the fluid into the intermediate bin or the collector bin, and a return pipe connecting the intermediate bin with the pulverizer to feed the material in the intermediate bin back into the pulverizer, whereby the fluid-carried material can be circulated between the pulverizer and the intermediate bin.

According to the present invention, the material can be pulverized in a short period of time because the pulverizer is operated without intermission. Further, the pulverizing capacity, which is the sum of the volume of the pulverizer and that of the intermediate bin, can be increased inexpensively by increasing the volume of the less expensive intermediate bin.

The provision of the classifier will serve to improve the pulverizing efficiency. The material left in the shell may be repulverized to prevent coarser particles from being mixed in the end product, thus improving its quality.

Other features and objects of the present invention will become apparent from the following description taken with reference to the accompanying drawings, in which:

FIG. 6 is a timing chart showing the operating procedure for the system of FIG. 5; and FIGS. 7 to 9 are schematic piping diagrams of the prior art apparatus.

Figure 1:
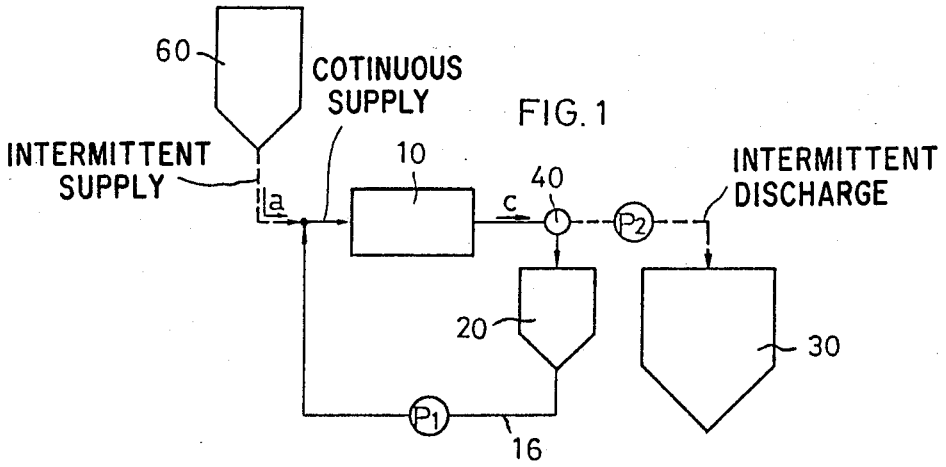
FIGS. 1 to 4 are schematic piping diagrams of the embodiments of the present invention.

The operation of the apparatus according to the present invention is as follows. In FIG. 1, a pulverizer 10 is put into communication with an intermediate bin 20 by means of a changeover valve 40. A pump P1 is actuated with the circulating pipe connecting the pulverizer 10 with the intermediate bin 20 filled with a liquid such as water. At the same time, the material a to be pulverized in a supply bin 60 is introduced by a desired amount into the pulverizer 10 by means of a feeder. The material is pulverized and classified in the liquid flow formed in the pulverizer 10. The pulverized product c is circulated between the intermediate bin 20 and the pulverizer 10.

The amount of the material a to be fed into the pulverizer at a time is determined according to the capacity of the pulverizer 10. It is not essential that the circulating pipe be filled with liquid beforehand. Liquid may be introduced into the pulverizer 10 together with the material a to be pulverized. In this case, the supply of liquid is stopped when the circulating pipe is filled up.

The pulverized product c undergoes a gradual reduction in the particle size while being circulated between the pulverizer and the intermediate bin. When pulverized to a desired particle size, the pulverizer is put into communication with a product collector bin 30 by controlling the changeover valve 40 and a pump P2 is actuated to feed the pulverized product c into the bin 30.

After all the pulverized product c in the intermediate bin 20 has been fed into the collector bin 30, the pulverizer 10 is connected again to the intermediate bin 20 by means of the changeover valve 40 and the material a to be pulverized is fed into the pulverizer to repeat the above-described operation.

If the pump P2 is not provided, it is necessary to use the pump P1 to feed the pulverized product into the product bin 30. In such a case, each cycle of operation ends when the intermediate bin 20 is emptied.

It will be now apparent that the per-cycle pulverizing capacity of the apparatus according to the present invention depends on the sum of the volume of the pulverizer 10 and that of the intermediate bin 20. The intermediate bin 20 should have a volume several times to several tens of times that of the pulverizer 10.

Since the collector bin 30 is kept out of communication with the other parts of the apparatus during the pulverizing or circulating operation, the product in the collector bin can be discharged therefrom without stopping the pulverizer.

Figure 2:
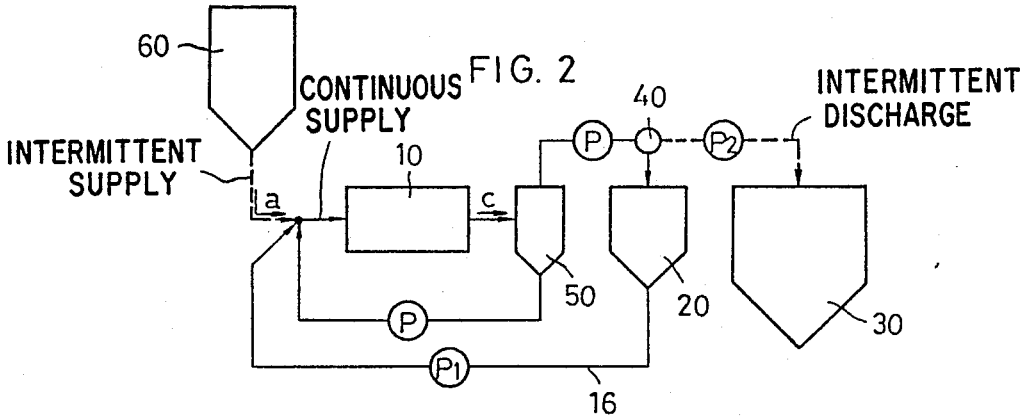

As shown in FIG. 2, the apparatus of the present invention may be provided with a classifier 50 to repulverize the coarser particles in the pulverized product c more quickly and more efficiently. Letters P designate pumps throughout the several figures.

Figure 3:
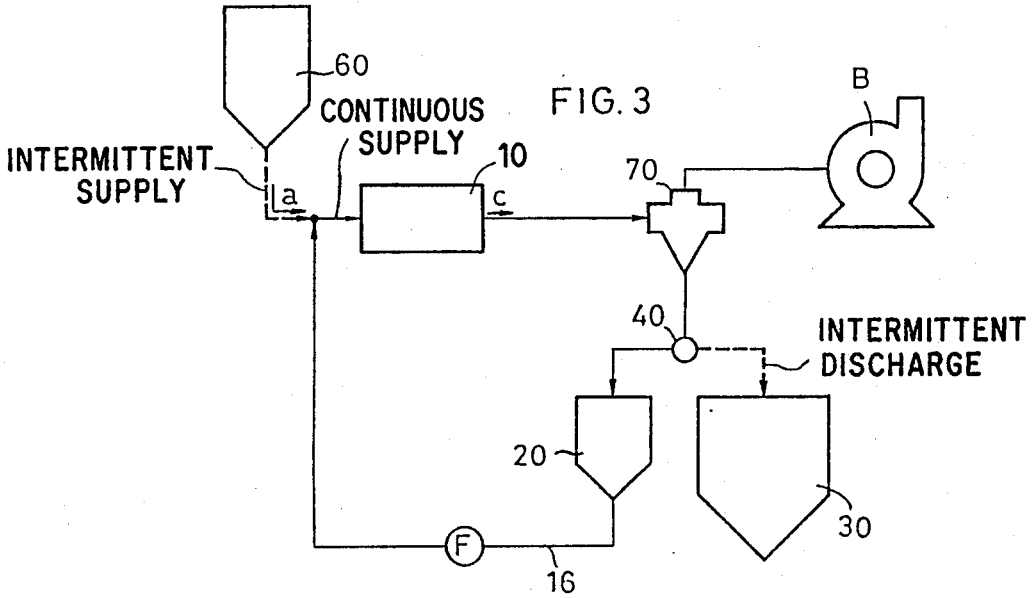
Figure 4:
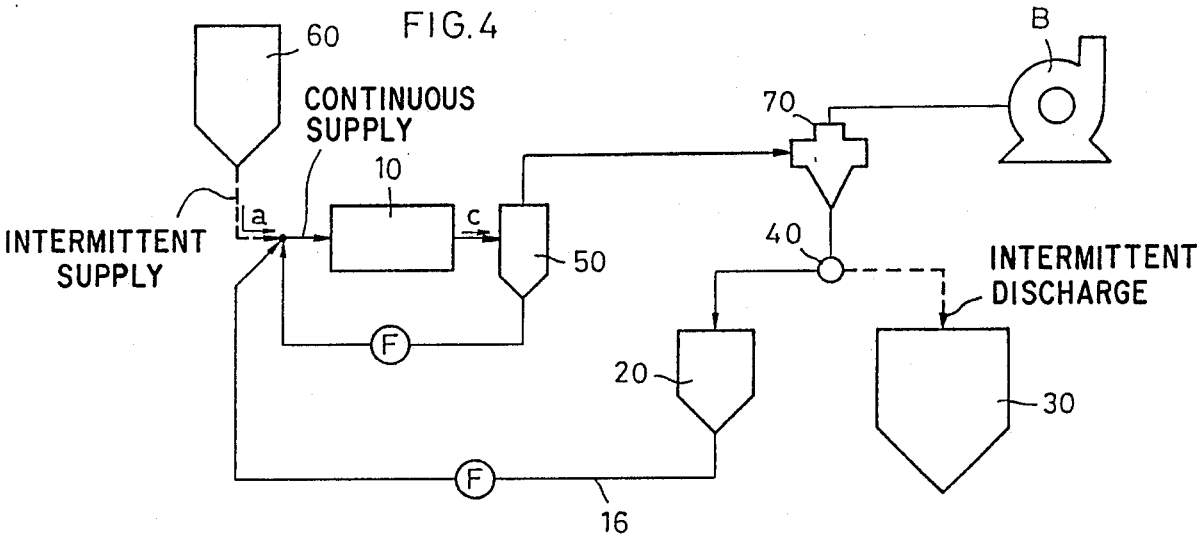

With the apparatus shown in FIGS. 3 and 4 wherein gas is used as a material carrier, the gas is adapted to flow through the pulverizer 10 by actuating a fan B connected to the pulverizer 10 through a separator 70 such as a cyclone. The pulverizer 10 is selectively brought into communication with the intermediate bin 20 or the end product collector bin 30 by controlling the changeover valve 40. The material fed into the bin 20 is returned to the pulverizer 10 through a feeder means F such as a pneumatic conveyor. The gas expelled from the fan B may be fed into the pulverizer 10 to form a closed gas circuit.

Figure 5:
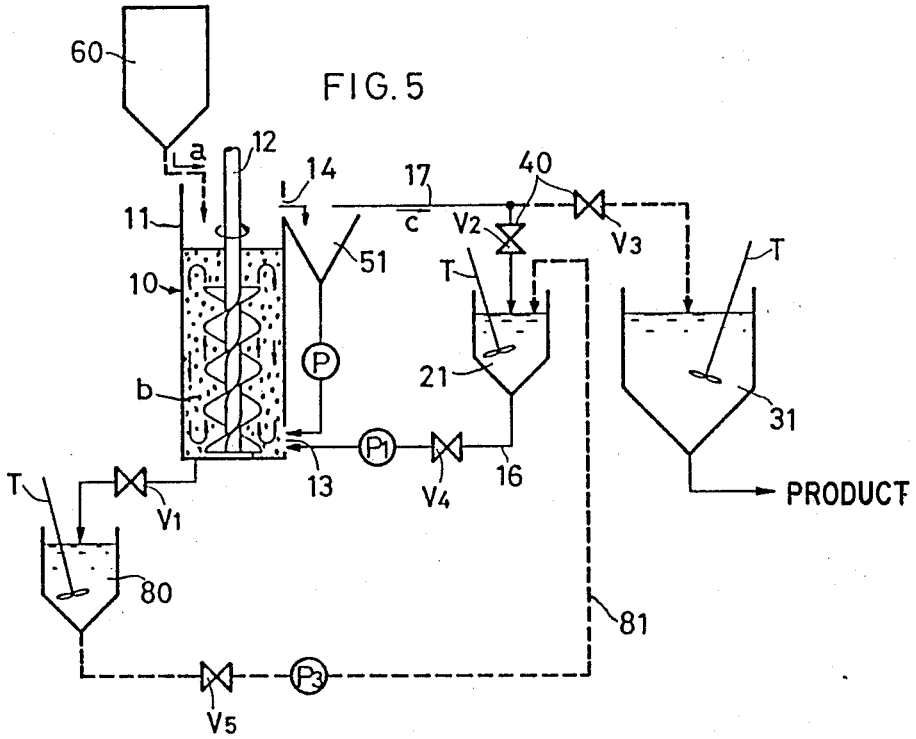
FIG. 5 is a similar view of an entire system.

As shown in FIG. 5, a pulverizer 10 has a cylindrical shell 11 filled with a pulverizing medium to a required height and having a screw shaft 12 rotatably mounted along its axis. The material a to be pulverized is introduced into the shell 11 with the screw shaft 12 rotating so as to be agitated in the shell in such a manner as shown by arrows. The material a is thus pulverized into a particulate product c by the grinding between its particles and between the material a and the pulverizing medium b.

The shell 11 is formed in its lower portion with a water inlet 13. Water is introduced through the inlet 13 and flows upwardly in the shell. The particulate product c is classified by the upward current to be carried out of the shell 11 through an outlet 14 at its top into a settling classifier 51. The coarser particles of the material c, which have settled down in the classifier 51, are fed into the shell 11 by a pump P through the inlet 13 so as to be pulverized again.

The shell 11 has its bottom connected to an auxiliary bin 80 through an on-off valve V1. Opening the valve V1 will cause the water and the material a to be pulverized as well as the pulverized particulate product c in the shell 11 to fall by gravity into the auxiliary bin 80. The contents in the shell 11 may be forcibly drawn into the bin 80 by means of a pump.

The settling classifier 51 includes an overflow pipe 17 connected to an intermediate bin 21 and an end product collector bin 31 through on-off valves V2 and V3, respectively. The slurry water which overflows the shell 11 contains the pulverized particulate product c and will be directed into the intermediate bin 21 if the valve V2 is open with the valve V3 closed or into the collector bin 31 if the valve V2 is closed with the valve V3 open.

The intermediate bin 21 is connected to the inlet port 13 of the shell 11 through a return pipe 16 provided with a pump P1 and an on-off valve V4. By opening the valve V4 and actuating the pump P1, the slurry water containing the particulate product c (hereinafter merely referred to as water) will be returned into the shell 11. The intermediate bin 21 is also connected to the auxiliary bin 80 through a liquid supply pipe 81 provided with a pump P3 and an on-off valve V5. The water in the auxiliary bin 80 is fed into the intermediate bin 21 by means of the pump P3. Letters T indicate agitators.

Now, the operation of the preferred embodiment will be described with reference to the timing chart of FIG. 6 in which solid lines mean that the respective parts are in operation or opened.

In the first place, the valve V2 is opened, the pulverizer 10 is activated and the material a to be pulverized is fed into the shell 11 together with water. The material a is pulverized and classified while flowing in the up-and-down currents in the shell. The pulverized particulate product c overflows the shell to be fed into the classifier 51. The coarser particulate product c will settle in the classifier 51 and will be fed back into the shell 11, whereas the finer product c will overflow the classifier 51 so as to be fed into the intermediate bin 21.

When the intermediate bin 21 becomes full, the supply of the material a to be pulverized is stopped and the on-off valve V4 is opened to feed the water in the intermediate bin 21 into the shell 11 by means of the pump P1. The material will be then circulated through the pulverizer 10, classifier 51, intermediate bin 21 to be further pulverized.

When the particulate product c overflowing the shell 11 has been pulverized to a predetermined particle size, the on-off valve V2 is closed and the valve V3 is opened to direct the liquid containing the particulate product c into the end product collector bin 31. The pump P1 is deactivated and the valve V4 is closed when the intermediate bin 21 becomes empty.

Then the valve V1 is opened to transfer the water in the shell 11 into the auxiliary bin 80. The water in the shell 11 may be drawn out by means of a pump so as to be fed into the collector bin 31. But the water in the shell 11 contains unpulverized coarse particles which are unacceptable as an end product, because part of the water is not circulated through the apparatus but remains settled in the shell and the piping. Thus it is preferable to transfer the water in the shell to the auxiliary bin 80 so as to feed it back to the shell during the next pulverizing cycle.

The above-described operation can be repeated without stopping the pulverizer 10.

The apparatus of the preferred embodiment was used to pulverize zircon sands in a liquid having a concentration of 60 per cent. It was confirmed that the sands were entirely and uniformly pulverized to a particulate product less than 3 microns in particle size.

What is claimed is:

1. A method of pulverizing a material into a particulate product by agitating the material to be pulverized in a fluid flow together with a pulverizing medium to pulverize the material by the friction between the particles of the material and between the material and the pulverizing medium, comprising the steps of: agitating said material in a pulverizer adapted to be selectively connected with an intermediate bin or a product collector bin, connecting said pulverizer with said intermediate bin to circulate the fluid-carried material between said intermediate bin and said pulverizer until the material is pulverized to a desired particle size, connecting said pulverizer with said product collector bin to direct the product pulverized to the desired particle size to said collector bin, discharging material and fluid from said pulverizer at the end of each pulverizing cycle into an auxiliary bin, and feeding said discharged material and fluid back into said pulverizer at the beginning of a subsequent pulverizing cycle.

2. A method of pulverizing material into a particulate produce as claimed in claim 1, further including the step of: classifying the material on its way from said pulverizer to said intermediate bin into finer and coarser materials according to particle size and returning the coarser material to said pulverizer.

3. An apparatus for pulverizing a material into a particulate product, comprising a pulverizer having a pulverizing shell in which the material to be pulverized is agitated in a fluid flow together with a pulverizing medium to pulverize the material by the friction between particles of the material and between the material and the pulverizing medium, an intermediate bin and a product collector bin adapted to be selectively connected with said pulverizer, a valve means for selecting the connection so that the pulverized product in said pulverizer shell will be carried by the fluid into said intermediate bin or said collector bin, a return pipe connecting said intermediate bin with said pulverizer to feed the material in said intermediate bin back into said pulverizer shell, an auxiliary bin for receiving material from said pulverizer shell, a valve controlling the flow of material from said pulverizer shell to said auxiliary bin, and conduit means connecting said auxiliary bin to said intermediate bin for returning material from said auxiliary bin to said intermediate bin, whereby the fluid-carried material can be selectively circulated between said pulverizer shell and said intermediate bin or said collector bin and the material in said pulverizer shell can be discharged to said auxiliary bin and fed back to said intermediate bin.

4. An apparatus as claimed in claim 3, further comprising a classifier provided between said pulverizer and said valve means and having an overflow port connected to said valve means and an underflow port connected to said pulverizer.

* * * * *